US007803012B2

(12) United States Patent
Shen et al.

(10) Patent No.: US 7,803,012 B2
(45) Date of Patent: Sep. 28, 2010

(54) CABLE COLLECTOR OF POWER SUPPLY APPARATUS

(75) Inventors: Yu-Cheng Shen, Taipei (TW); Min-Hua Hsu, Taipei (TW)

(73) Assignee: Asustek Computer Inc., Peitou, Taipei (TW)

( * ) Notice: Subject to any disclaimer, the term of this patent is extended or adjusted under 35 U.S.C. 154(b) by 0 days.

(21) Appl. No.: 12/437,703

(22) Filed: May 8, 2009

(65) Prior Publication Data

US 2010/0068920 A1 Mar. 18, 2010

(30) Foreign Application Priority Data

Sep. 12, 2008 (TW) ..... 97135166 A

(51) Int. Cl.
*H01R 13/72* (2006.01)

(52) U.S. Cl. ..... 439/501

(58) Field of Classification Search ..... 439/501
See application file for complete search history.

(56) References Cited

U.S. PATENT DOCUMENTS

| | | | | |
|---|---|---|---|---|
| 3,566,332 | A * | 2/1971 | Bonhomme | 439/501 |
| 3,689,868 | A * | 9/1972 | Snyder | 439/501 |
| 4,095,871 | A * | 6/1978 | Holte | 439/501 |
| 6,503,097 | B2 * | 1/2003 | Archambault | 439/501 |
| 7,081,006 | B2 * | 7/2006 | Lichtscheidl et al. | 439/501 |
| 7,172,456 | B1 * | 2/2007 | Nagy | 439/501 |
| 7,230,181 | B2 * | 6/2007 | Simmons et al. | 174/66 |
| 7,275,956 | B1 * | 10/2007 | Montesano | 439/501 |
| 2002/0168891 | A1 * | 11/2002 | Kitou et al. | 439/501 |
| 2004/0203277 | A1 * | 10/2004 | Chien | 439/501 |
| 2005/0130492 | A1 * | 6/2005 | Noh | 439/501 |
| 2008/0311786 | A1 * | 12/2008 | Laursen | 439/501 |
| 2009/0061677 | A1 * | 3/2009 | Tang et al. | 439/501 |

FOREIGN PATENT DOCUMENTS

| | | |
|---|---|---|
| CN | 2521784 | 11/2002 |
| TW | M290340 | 5/2006 |

OTHER PUBLICATIONS

English language translation of abstract of CN 2521784.
English language translation of abstract of TW M290340.

* cited by examiner

*Primary Examiner*—Gary F. Paumen
(74) *Attorney, Agent, or Firm*—Thomas, Kayden, Horstemeyer & Risley, LLP

(57) ABSTRACT

A cable collector of a power supply apparatus is provided. The power supply apparatus includes a power adaptor, a cable, and a cable collector. One side of the cable is connected with the power adaptor. The cable collector includes a first board, a first power connector, and two first blocking boards. The first board is connected with a first surface of the power adaptor. The first power connector is formed on the first board. The first board is connected with the power adaptor via the first power connector. The two first blocking boards are formed on two sides of the first board.

11 Claims, 5 Drawing Sheets

CABLE COLLECTOR OF POWER SUPPLY APPARATUS

RELATED APPLICATIONS

This application claims priority to Taiwan Application Serial Number 97135166, filed on Sep. 12, 2008, which is herein incorporated by reference.

BACKGROUND OF THE INVENTION

1. Field of the Invention

The invention relates to a cable collector and, more particularly, to a cable collector used in a power supply apparatus.

2. Description of the Related Art

Nowadays, electrical devices are already necessities in people's life. More electrical devices in life are accompanied by more power supplies provided for the electrical devices. The power supplies of some electrical devices such as a notebook are detachable. However, how to collect power cables trimly after disassembling is an issue. Common cable collectors are designed according to different sizes of power supplies. If a user has power supplies with different sizes at the same time, the number of the cable collectors is increased along with the increase of the number of the power supplies.

BRIEF SUMMARY OF THE INVENTION

The invention provides a cable collector used for collecting a power cable of a power supply apparatus. The cable collector includes a board, a first power connector formed on the board, and two blocking boards formed on two opposite sides of the board.

The invention further provides a power supply apparatus. The power supply apparatus includes a power adaptor, a power cable, and a cable collector. An end of the power cable is connected with the power adaptor. The cable collector includes a first board, a first power connector, and two first blocking boards. The first board is connected with a first surface of the power adaptor. The first power connector is formed on the first board. The first board is connected with the power adaptor via the first power connector. The two first blocking boards are formed on two opposite sides of the first board.

The advantages of the invention is that after power cables are wound at a power adaptor of a power supply apparatus, the collecting effect can be obtained via the two blocking boards of the cable collector preventing the power cable from sliding.

These and other features, aspects and advantages of the present invention will become better understood with regard to the following description, appended claims, and accompanying drawings.

DETAILED DESCRIPTION OF THE EMBODIMENTS

One issue solved by the invention is to provide a new cable collector. Thus, cables of power supplies with different sizes may be collected by the same cable collector.

Figure 1A:
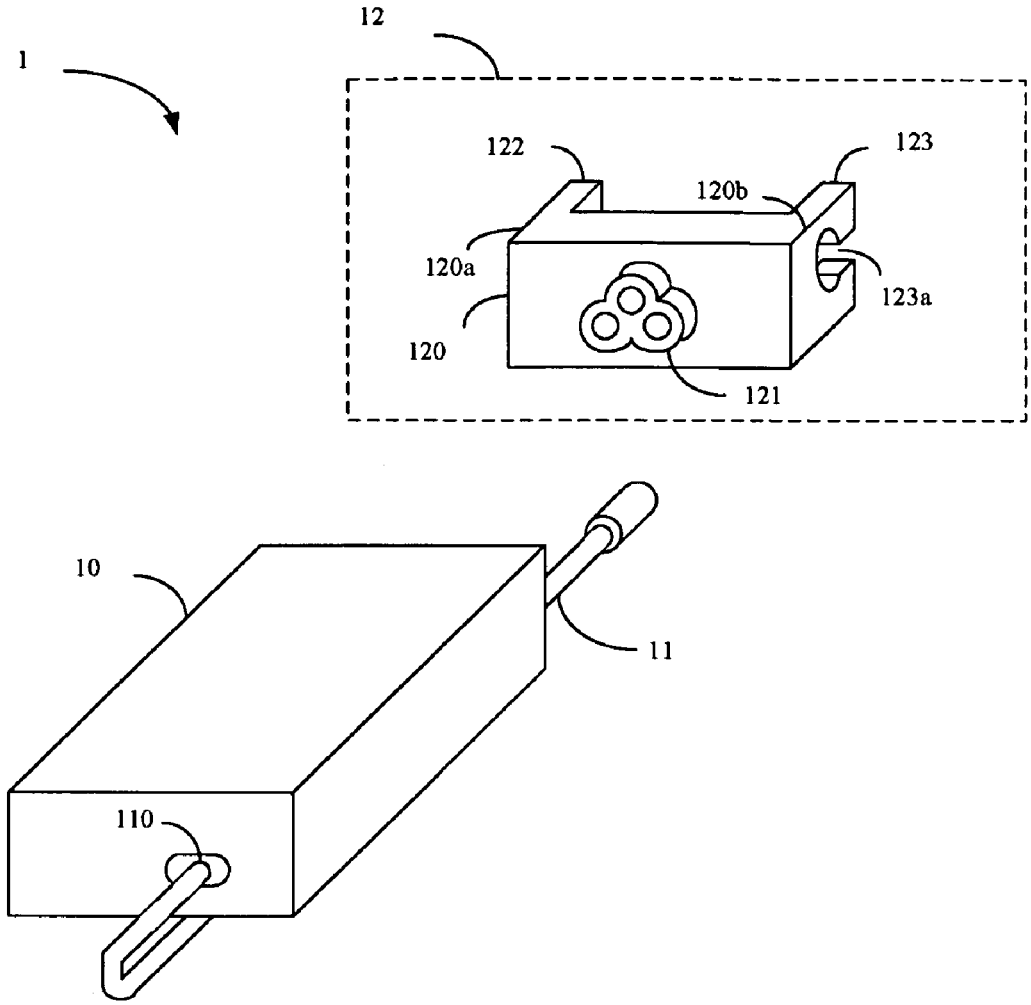
FIG. 1A is a three-dimensional exploded diagram showing a power supply apparatus according to a first embodiment of the invention.
Figure 1B:
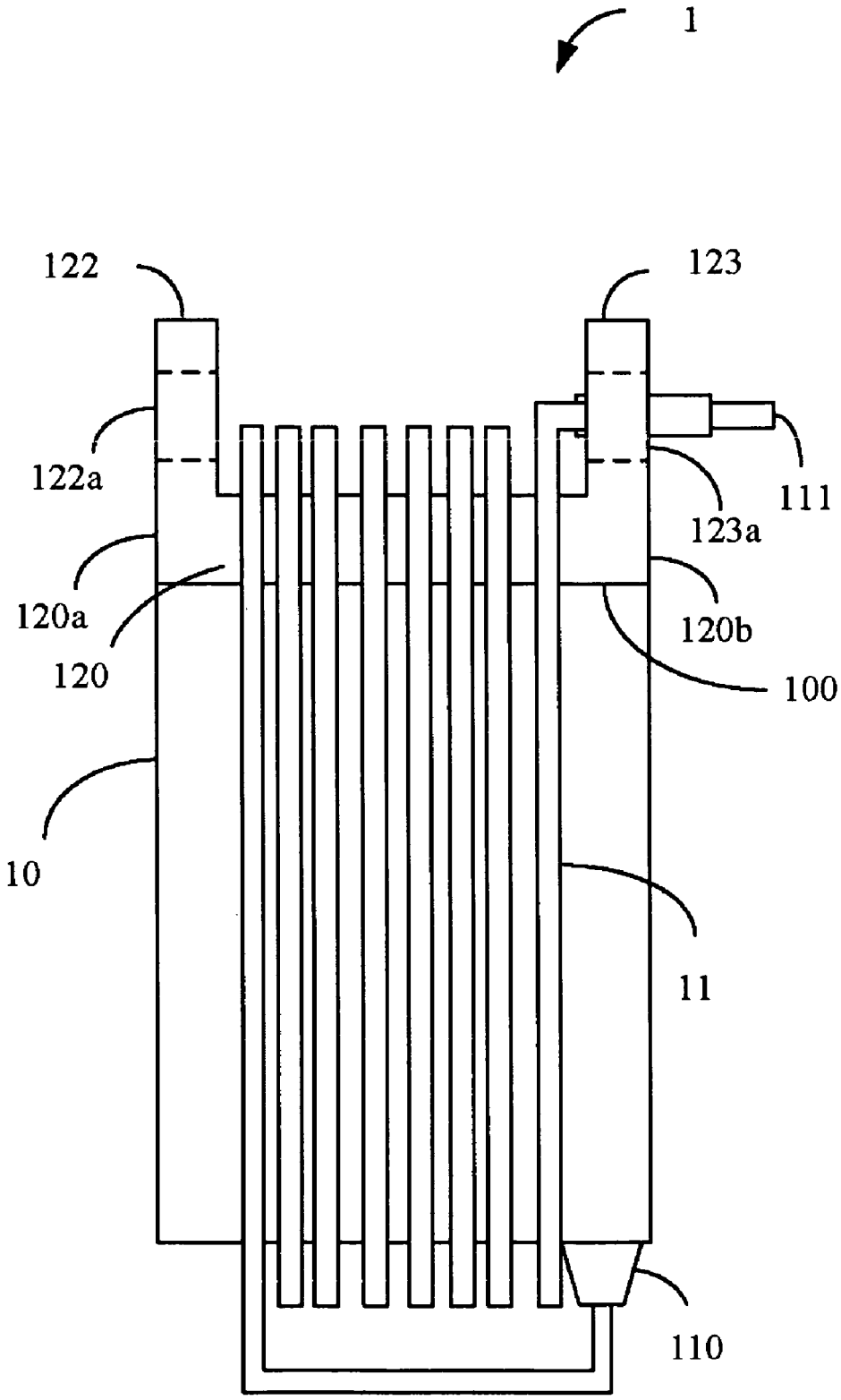
FIG. 1B is a side view diagram of the power supply apparatus according to the first embodiment of the invention.

FIG. 1A is a three-dimensional exploded diagram showing a power supply apparatus 1 according to a first embodiment of the invention. The power supply apparatus 1 includes a power adaptor 10, a power cable 11, and a cable collector 12. An end 110 of the power cable 11 is connected with the power adaptor 10. The cable collector 12 includes a first board 120, a first power connector 121, and two first blocking boards 122 and 123. FIG. 1B is a side view diagram of the power supply apparatus 1 according to the first embodiment of the invention. The first board 120 is connected with a first surface 100 of the power adaptor 10. The first power connector 121 is formed on the first board 120. The first board 120 is connected with the power adaptor 10 via the first power connector 121. The first power connector 121 is one of a C6 connector, a C8 connector, and a C14 connector. In this embodiment, the first power connector 121 is a C6 connector. People skilled in the art can easily change the power connector to one with other form in other embodiments. The power adaptor 10 has a power connector (not shown) connected with the first power connector 121. The two power connectors are complementary. One of the two power connectors is a female connector, and the other one is a male connector. Thus the first power connector 121 can closely connect with the power adaptor 10. The two first blocking boards 122 and 123 are formed on two opposite sides 120*a* and 120*b* of the first board 120. The two first blocking boards 122 and 123 include a hole 122*a* and a hole 123*a*, respectively, in which the other end 111 of the power cable may be embedded. In FIG. 1B, after the power cable 11 is wound in several turns at the power adaptor 10, due to the blocking function of the two first blocking boards 122 and 123, the power cable 11 cannot slide away from the power adaptor 10. The holes 122*a* and 123*a* are further provided for embedding the end 111 of the power cable 11 in, and the power cable 11 can be prevented from sliding away. Additionally, via the first power connector 121, the cable collector 12 can be easily connected with any the power adaptor 10 with a connector which is complementary to the first power connector 121. Consequently, the cable collector 12 can be used to cooperate with the power supply apparatus 1 having a power adaptor 10 with different sizes without being re-designed according to different sizes of the power adaptor 10.

Figure 2A:
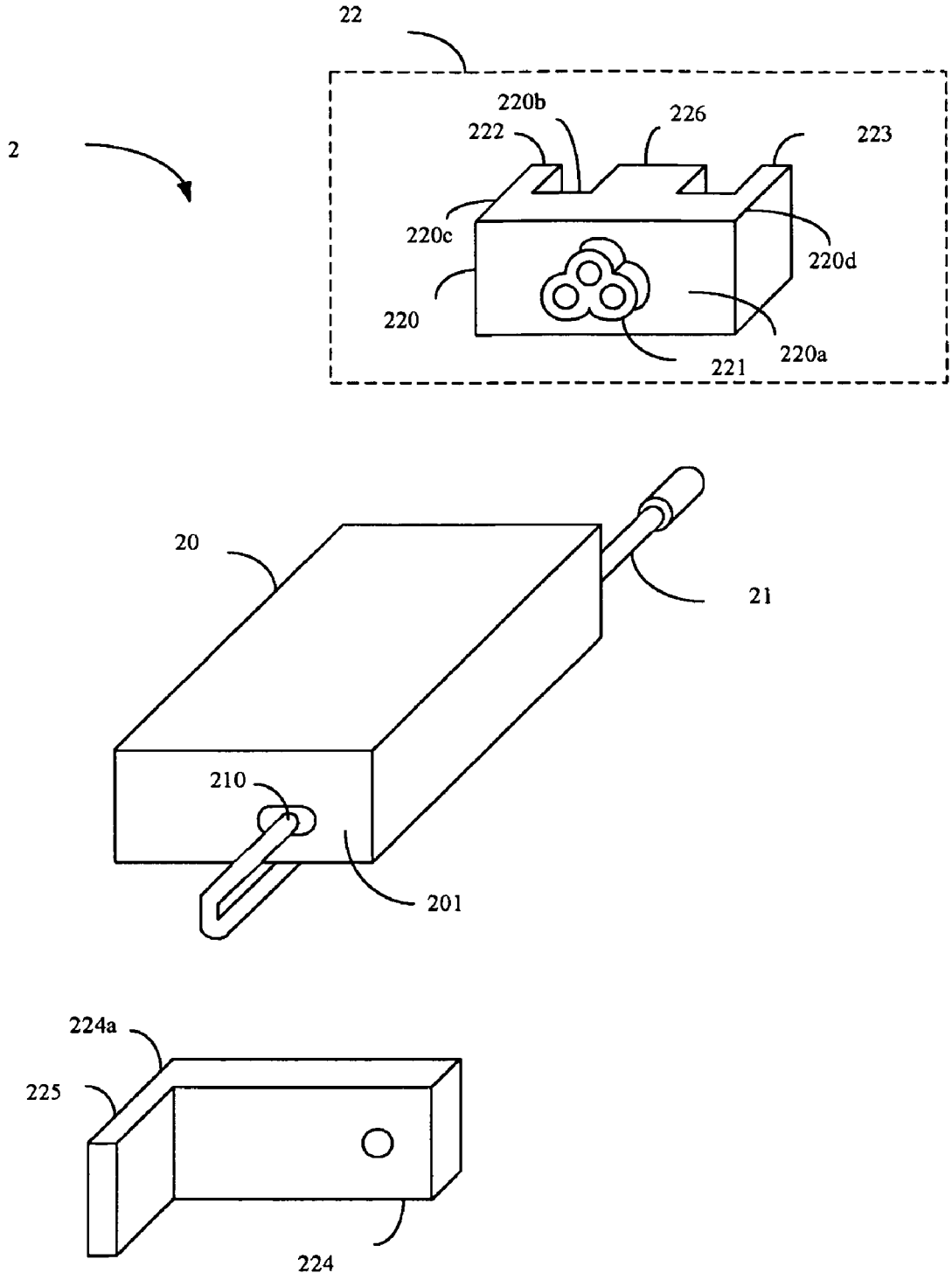
FIG. 2A is a three-dimensional exploded diagram showing a power supply apparatus according to a second embodiment of the invention.
Figure 2B:
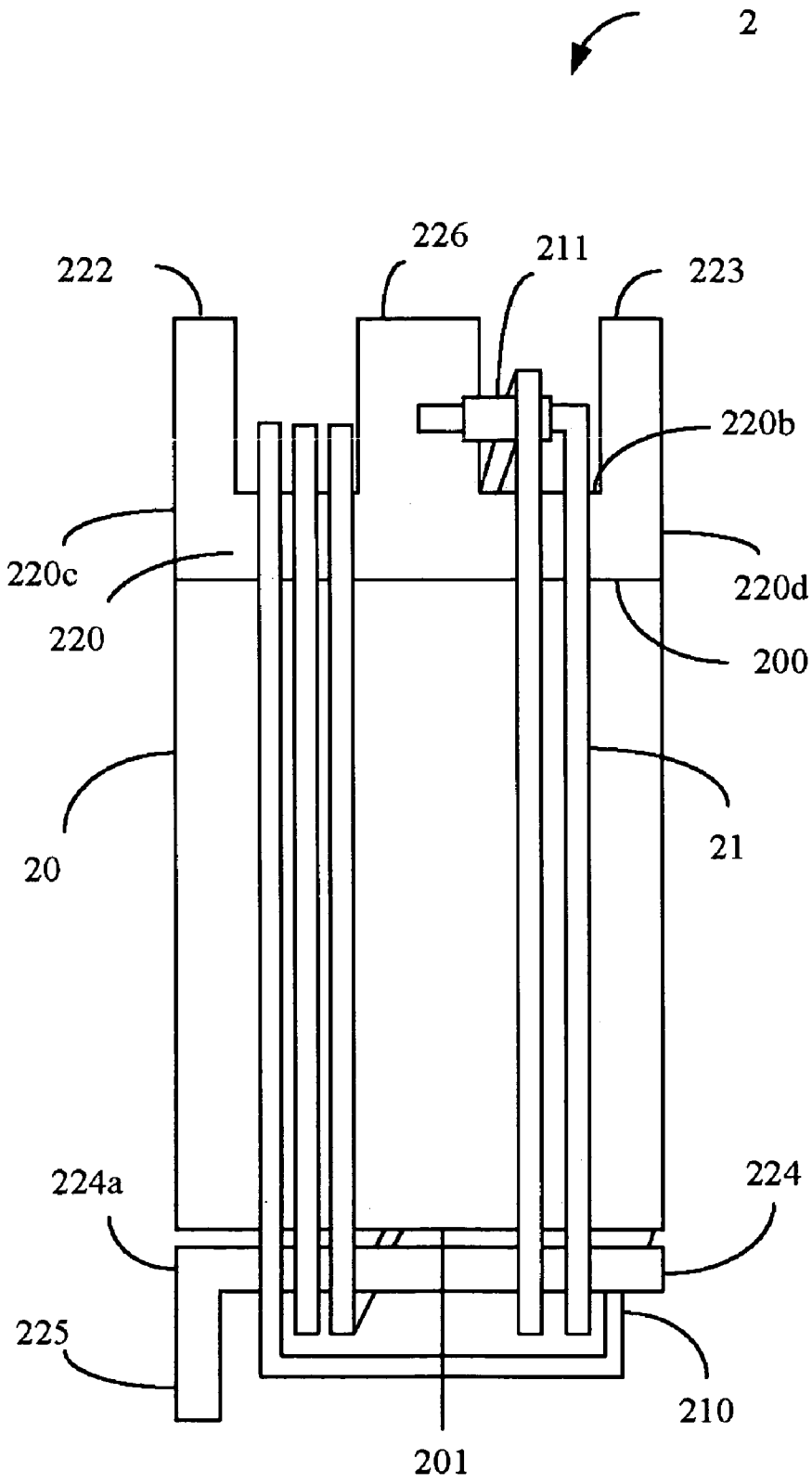
FIG. 2B is a side view diagram of the power supply apparatus according to the second embodiment of the invention.

FIG. 2A is a three-dimensional exploded diagram showing a power supply apparatus 2 according to a second embodiment of the invention. The power supply apparatus 2 includes a power adaptor 20, a power cable 21, and a cable collector 22. An end 210 of the power cable 21 is connected with the power adaptor 20. The cable collector 22 includes a first board 220, a first power connector 221, and two first blocking boards 222 and 223. FIG. 2B is a side view diagram of the power supply apparatus 2 according to the second embodiment of the invention. The first board 220 is connected with a first surface 200 of the power adaptor 20. The first power connector 221 is formed on a first plane surface 220*a* of the first board 220. The first board 220 is connected with the power adaptor 20 via the first power connector 221. The first board 220 includes a second plane surface 220*b* having a second power connector 226. As stated in the first embodiment, the power adaptor 20 has a power connector (not shown) thereon connected with the first power connector 221. The two power connectors are complementary. The second power connector 226 is complementary to the first power connector 221. Thus, the form of the second power connector 226 is the same as that of the power connector (not shown) on the power adaptor 20. The power adaptor 20 has a function of converting an alternating current (AC) power supply to a direct current (DC) power supply. The power cable 21 is a DC power cable. Via the second power connector 226, an AC power cable (not shown) can be directly connected with the second power connector 226 to allow the power supply apparatus 2 to convert AC power supply to DC power supply without disassembling the cable collector 22.

The two first blocking boards 222 and 223 are formed on two opposite sides 220*c* and 220*d* of the first board 220. The second board 224 is connected with a second surface 201 of the power adaptor 20. A second blocking board 225 is formed on a side 224*a* of the second board 224. In this embodiment, the two first blocking boards 222 and 223 have no holes. After the power cable 21 is wound in several turns at the power adaptor 20, due to the blocking function of the two first blocking boards 222 and 223 and the second blocking board 225, the power cable 21 cannot slide away from the power adaptor 20. The other end 211 of the power cable 21 is fixed by directly winding the other end 211 into a turn. If the hole is formed on the first blocking board as stated in the first embodiment, a better fixing function can be achieved. In the art, the AC power cable (not shown) can be fixed in the same way.

Figure 3A:
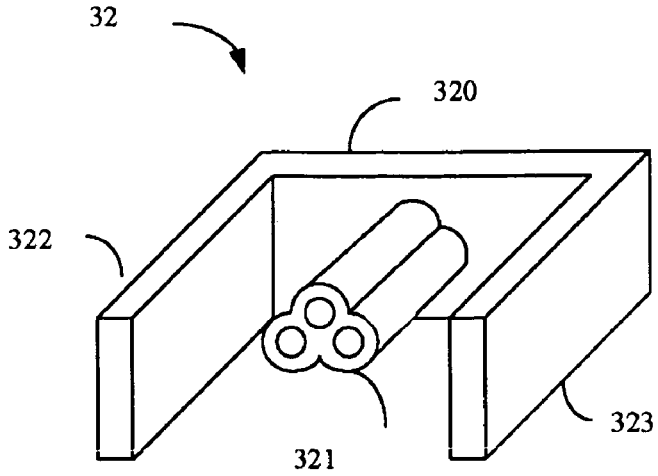
FIG. 3A is a three-dimensional exploded diagram showing a cable collector according to a third embodiment of the invention.
Figure 3B:
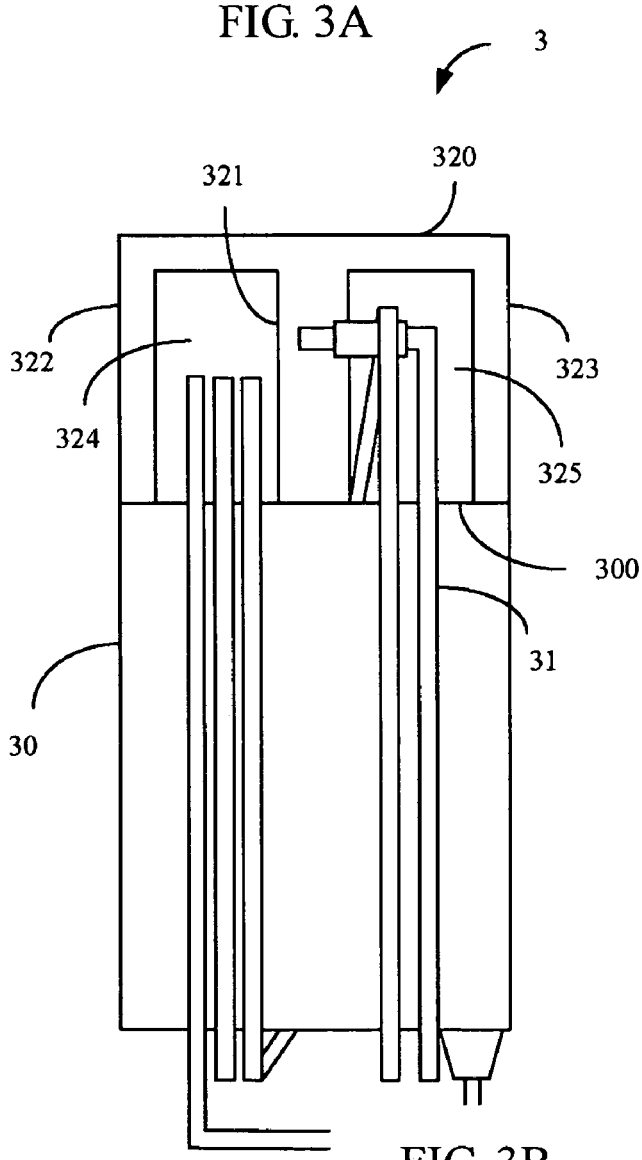
FIG. 3B is a side view diagram of a power supply apparatus according to the third embodiment of the invention.

FIG. 3A is a three-dimensional exploded diagram showing a cable collector according to a third embodiment of the invention. The cable collector 32 includes a first board 320, a first power connector 321, and two first blocking boards 322 and 323. FIG. 3B is a side view diagram of a power supply apparatus 3 according to the third embodiment of the invention. In this embodiment, the configuration of a power adaptor 30 and a power cable 31 of the power supply apparatus 3 is the same as that of the power adaptors and the power cables in the first and second embodiments. The biggest difference is that the first board 320 does not directly contact a first surface 300 of the power supply apparatus 3, and it is connected with the first surface 300 via a long first power connector 321 at a distance. Two spaces 324 and 325 are formed between the two first blocking boards 322 and 323 formed on two sides 320*a* and 320*b* of the first board 320 and the first power connector 321, respectively. Consequently, the power cable 31 in this embodiment is wound in several turns through the two spaces 324 and 325, and the fixing function can be achieved.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A cable collector used for collecting a power cable of a power supply apparatus, comprising:
- a board;
- a first power connector formed on the board; and
- two blocking boards formed on two opposite sides of the board, wherein the board comprises a first plane surface and a second plane surface, the first power connector is formed on the first plane surface, a second power connector is formed on the second plane surface, and the structure of the second power connector is complementary to the structure of the first power connector.

2. The cable collector according to claim 1, wherein one of the two blocking boards comprises a hole for embedding an end of the power cable in.

3. The cable collector according to claim 1, wherein each of the blocking boards comprises a hole for embedding an end of the power cable in.

4. The cable collector according to claim 1, wherein the first power connector is one of a C6 connector, a C8 connector, and a C14 connector.

5. The cable collector according to claim 1, wherein the second power connector is used for connecting a AC power cable.

6. A power supply apparatus, comprising:
- a power adaptor;
- a power cable, wherein an end of the power cable is connected with the power adaptor; and
- a cable collector including:
  - a first board connected with a first surface of the power adaptor;
  - a first power connector formed on the first board, wherein the first board is connected with the power adaptor via the first power connector; and
  - two first blocking boards formed on two opposite sides of the first board.

7. The power supply apparatus according to claim 6, further comprising:
- a second board connected with a second surface of the power adaptor; and
- at least a second blocking board formed on at least a side of the second board.

8. The power supply apparatus according to claim 6, wherein one of the two first blocking boards comprises a hole for embedding the other end of the power cable in.

9. The power supply apparatus according to claim 6, wherein the first power connector is one of a C6 connector, a C8 connector, and a C14 connector.

10. The power supply apparatus according to claim 6, wherein the first board comprises a first plane surface and a second plane surface, the first power connector is formed on the first plane surface, a second power connector is formed on the second plane surface, and the structure of the second power connector is complementary to the structure of the first power connector.

11. The power supply apparatus according to claim 10, wherein the second power connector is used for connecting a AC power cable.

* * * * *